US011501896B2

(12) United States Patent
Farkas et al.

(10) Patent No.: US 11,501,896 B2
(45) Date of Patent: Nov. 15, 2022

(54) APERIODICALLY OVERLAPPING SPIRAL-WRAPPED CABLE SHIELD SYSTEM

(71) Applicant: Dell Products L.P., Round Rock, TX (US)

(72) Inventors: Sandor Farkas, Round Rock, TX (US); Ching-Huei Chen, Taoyuan (TW); Bhyrav Mutnury, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 15 days.

(21) Appl. No.: 17/123,698

(22) Filed: Dec. 16, 2020

(65) Prior Publication Data

US 2022/0189658 A1 Jun. 16, 2022

(51) Int. Cl.
*H01B 7/02* (2006.01)
*H01B 7/22* (2006.01)
*H01B 7/18* (2006.01)

(52) U.S. Cl.
CPC ..... *H01B 7/226* (2013.01); *H01B 7/02* (2013.01); *H01B 7/1875* (2013.01)

(58) Field of Classification Search
CPC ..... H01B 7/02; H01B 7/18; H01B 7/1875; H01B 7/226; H01B 7/0241; H01B 7/221; H01B 7/30; H01B 9/02; H01B 11/002; H01B 11/06; H01B 11/08; H01B 11/085; H01B 11/10; H01B 11/1895
USPC ..... 174/102 R, 103, 108, 109, 110 R, 113 R
See application file for complete search history.

(56) References Cited

U.S. PATENT DOCUMENTS

| | | | | |
|---|---|---|---|---|
| 2,391,037 | A * | 12/1945 | Shafer, Jr. | H01B 7/22 174/102 R |
| 6,815,611 | B1 * | 11/2004 | Gareis | H01B 11/02 174/113 R |
| 7,525,045 | B2 * | 4/2009 | Archambeault | H01P 3/06 174/102 R |
| 8,575,488 | B2 * | 11/2013 | Sugiyama | H01B 7/17 174/105 R |
| 9,659,686 | B1 * | 5/2017 | McNutt | H01B 11/002 |
| 10,585,816 | B1 * | 3/2020 | Lambert | G06F 13/122 |
| 2006/0166054 | A1 * | 7/2006 | Ahmed | H01M 8/0612 429/442 |
| 2011/0247856 | A1 * | 10/2011 | Matsuda | H01B 11/203 174/108 |
| 2012/0145429 | A1 * | 6/2012 | Nordin | H01B 11/20 174/34 |

(Continued)

*Primary Examiner* — William H. Mayo, III
(74) *Attorney, Agent, or Firm* — Joseph Mencher

(57) ABSTRACT

An aperiodically overlapping spiral-wrapped cable shield system includes a cable having cable components such as a pair of conductors, at least one insulator surrounding the pair of conductors, and at least one drain wire. The cable also includes a cable shield that is spirally wrapped around the cable components with a varying wrap pitch that provides a plurality of overlapping cable shield portions with varying overlap areas. When signals are transmitted using the cable components in the cable, the varying overlap areas of the plurality of overlapping cable shield portions create a plurality of varying LC circuits that are configured to generate a resonance that does not exceed a signal integrity resonance threshold for a signals.

20 Claims, 15 Drawing Sheets

(56) References Cited

U.S. PATENT DOCUMENTS

| | | | | |
|---|---|---|---|---|
| 2012/0227998 | A1* | 9/2012 | Lindstrom | H01B 11/1025 174/103 |
| 2013/0333913 | A1* | 12/2013 | Nonen | H01B 11/1826 174/34 |
| 2018/0090243 | A1* | 3/2018 | Farkas | H01B 11/002 |
| 2018/0096755 | A1* | 4/2018 | Tsujino | H01B 7/0241 |

* cited by examiner

APERIODICALLY OVERLAPPING SPIRAL-WRAPPED CABLE SHIELD SYSTEM

BACKGROUND

The present disclosure relates generally to information handling systems, and more particularly to the aperiodic overlapping of spiral-wrapped cable shields on cables that are used to connect information handling systems and their components.

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Information handling systems such as, for example, server devices, networking devices, storage devices, and/or other computing devices known in the art, utilize cables to connect to each other, as well as to connect their components, and/or connect a variety of other computing subsystems known in the art. For example, dual-axial cables are often utilized for the transmission of high speed Serializer/Deserializer (serdes) signal transmissions, and typically include a pair of conducting wires that are each surrounded by an insulator, one or more drain wires, and a conductive cable shield that is wrapped around the conducting wires and drain wire(s) in a spiral orientation. The spiral wrapping of cable shields on cables can raise some issues.

As would be understood by one of skill in the art in possession of the present disclosure, as the speed at which signals are transmitted increases the signal integrity sensitivity of those signals to parasitic effects increases as well, and subtle effects that that do not impact signal performance at lower signals transmission speeds will begin to effect signal performance at higher signals transmission speeds. For example, it has been found that the spiral wrapping of cable shields on cables provides a repeating overlap of the cable shield that introduces a periodic return path discontinuity that produces a resonance effect on signal return losses/insertion losses at particular frequency ranges (which is also referred to as a "suck-out" effect). As discussed in further detail below, as a return current from the conductors in the cable returns via the cable shield during signal transmission via those conductors, the repeating overlap of the cable shield creates a plurality of substantially similar LC/"tank" circuits along the length of the cable that produces the resonance/"suck-out" effect in a frequency range that can produce signal attenuation when high speed signals are transmitted within that frequency range, which can result in signal losses. Furthermore, the elimination of such cable shield overlaps in order to prevent the issues discussed above produces further issues such as, for example, the introduction of signal radiation and discontinuities in the current return path (e.g., via gaps between the spirally-wrapped cable shield). Solutions to such issues include providing a uniform cable shield along the entire length of the cable (i.e., rather than spirally wrapping cable shield material around cable components), but the cost of such solutions increases exponentially with the length of the cable.

Accordingly, it would be desirable to provide a spiral-wrapped cable shield system that addresses the issues discussed above.

SUMMARY

According to one embodiment, an Information Handling System (IHS) includes a processing system; a memory system that is coupled to the processing system and that includes instructions that, when executed by the processing system, cause the processing system to provide a signal transmission engine that is configured to generate signals; and a cable that is coupled to the processing system and that is configured to transmit the signals, wherein the cable includes: a cable shield that is spirally wrapped with a varying wrap pitch that provides a plurality of overlapping cable shield portions with varying overlap areas, wherein the varying overlap areas of the plurality of overlapping cable shield portions create a plurality of varying LC circuits that are configured to generate a resonance that does not exceed a signal integrity resonance threshold for the signals.

DETAILED DESCRIPTION

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components.

Figure 1:
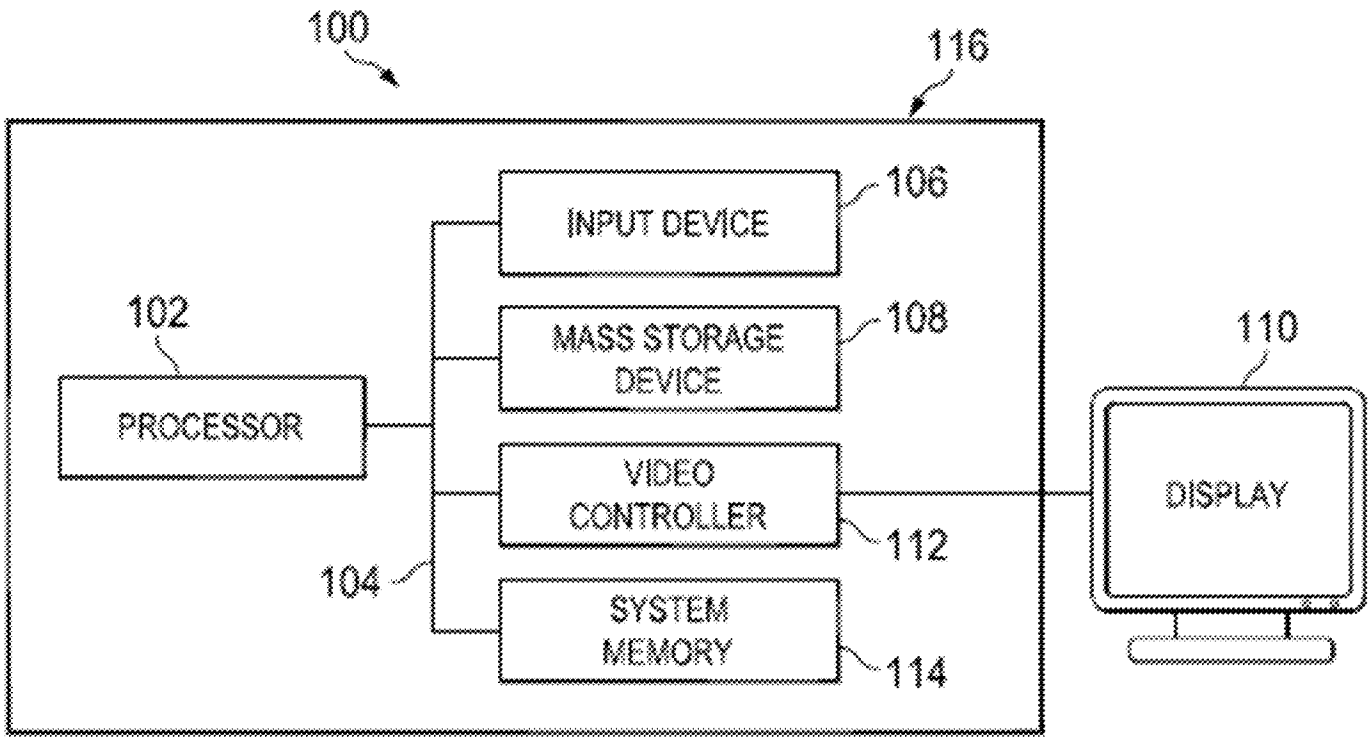
FIG. 1 is a schematic view illustrating an embodiment of an Information Handling System (IHS).

In one embodiment, IHS 100, FIG. 1, includes a processor 102, which is connected to a bus 104. Bus 104 serves as a connection between processor 102 and other components of IHS 100. An input device 106 is coupled to processor 102 to provide input to processor 102. Examples of input devices may include keyboards, touchscreens, pointing devices such as mouses, trackballs, and trackpads, and/or a variety of other input devices known in the art. Programs and data are stored on a mass storage device 108, which is coupled to processor 102. Examples of mass storage devices may include hard discs, optical disks, magneto-optical discs, solid-state storage devices, and/or a variety of other mass storage devices known in the art. IHS 100 further includes a display 110, which is coupled to processor 102 by a video controller 112. A system memory 114 is coupled to processor 102 to provide the processor with fast storage to facilitate execution of computer programs by processor 102. Examples of system memory may include random access memory (RAM) devices such as dynamic RAM (DRAM), synchronous DRAM (SDRAM), solid state memory devices, and/or a variety of other memory devices known in the art. In an embodiment, a chassis 116 houses some or all of the components of IHS 100. It should be understood that other buses and intermediate circuits can be deployed between the components described above and processor 102 to facilitate interconnection between the components and the processor 102.

Figure 2A:
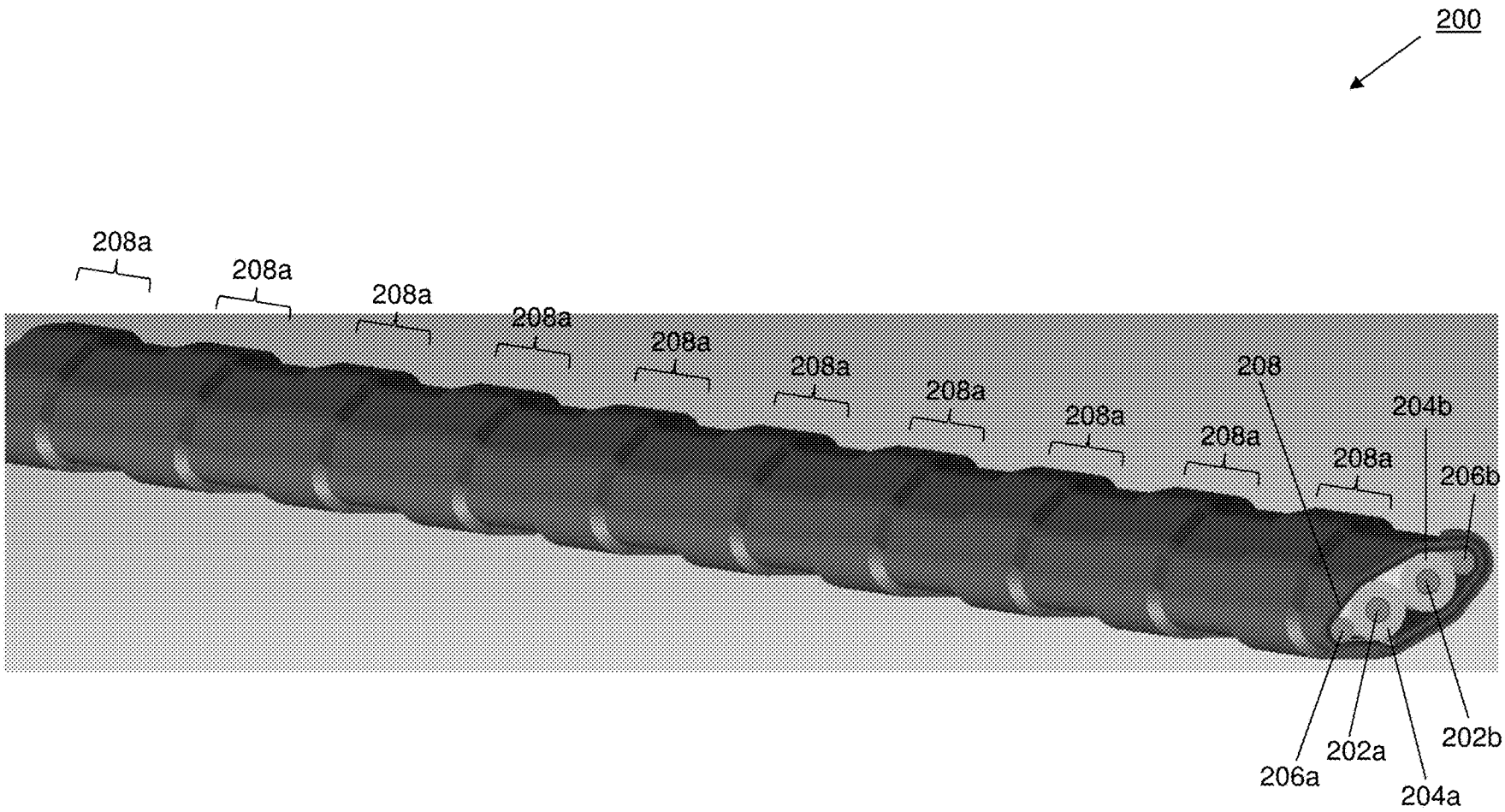
FIG. 2A is a perspective cut-away view illustrating an embodiment of a cable with a spiral-wrapped cable shield.
Figure 2B:
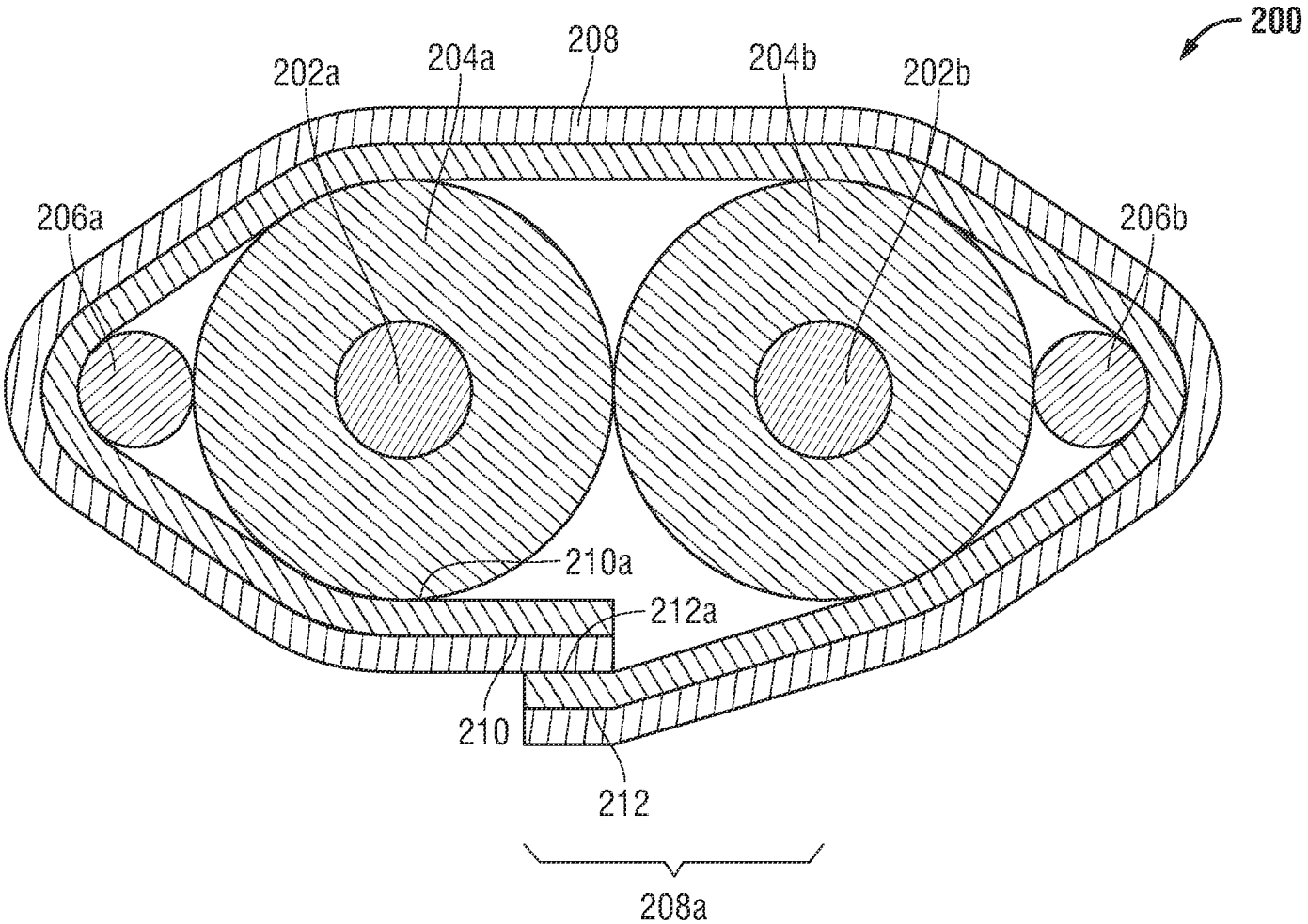
FIG. 2B is a cross section view illustrating an embodiment of the cable with the spiral-wrapped cable shield of FIG. 2A.

Referring now to FIGS. 2A and 2B, an embodiment of a cable 200 that may utilize the aperiodically overlapping spiral-wrapped cable shield of the present disclosure is illustrated. However, in the discussions below, the cable 200 is also used to describe conventional periodically overlapping spiral-wrapped cable shielding as well, and thus one of skill in the art in possession of the present disclosure will appreciate that different embodiments of the cable 200 illustrated in FIGS. 2A and 2B may include the overlapping cable shield portions discussed below with different characteristics (i.e., equal/substantially similar overlap areas, varying overlap areas, etc.). The cable 200 includes at least one cable component that, in the examples illustrated and discussed below, is provided by a pair of conductors 202*a* and 202*b* that may include a variety of conductive wiring that would be apparent to one of skill in the art in possession of the present disclosure, insulators 204*a* and 204*b* that surround the conductors 202*a* and 202*b*, respectively, and a pair of drain wires 206*a* and 206*b*. However, while specific cable components are illustrated and described below, one of skill in the art in possession of the present disclosure will appreciate that cables may include a variety of cable components and/or cable component configurations while remaining within with the scope of the present disclosure.

The cable 200 also includes a cable shield 208 that surrounds/houses the cable components, and that may be provided by a variety of conductive cable shielding materials that would be apparent to one of skill in the art in possession of the present disclosure. As will be appreciated by one of skill in the art in possession of the present disclosure and as illustrated in FIGS. 2A and 2B, the cable shield 208 may be spirally wrapped around the cable components in a manner that provides a plurality of overlapping cable shield portions 208*a* that each include a first portion 210 of the cable shield 208 that also includes a surface 210*a* that may engage at least one of the cable components, and a second portion 212 of the cable shield 208 having a surface 212*a* that engages the first portion of the cable shield 208. However, while a specific cable 200 has been illustrated and described, one of skill in the art in possession of the present disclosure will recognize that cables utilizing the aperiodically overlapping spiral-wrapped cable shield of the present disclosure may include a variety of components and component configurations while remaining within the scope of the present disclosure as well.

Figure 3:
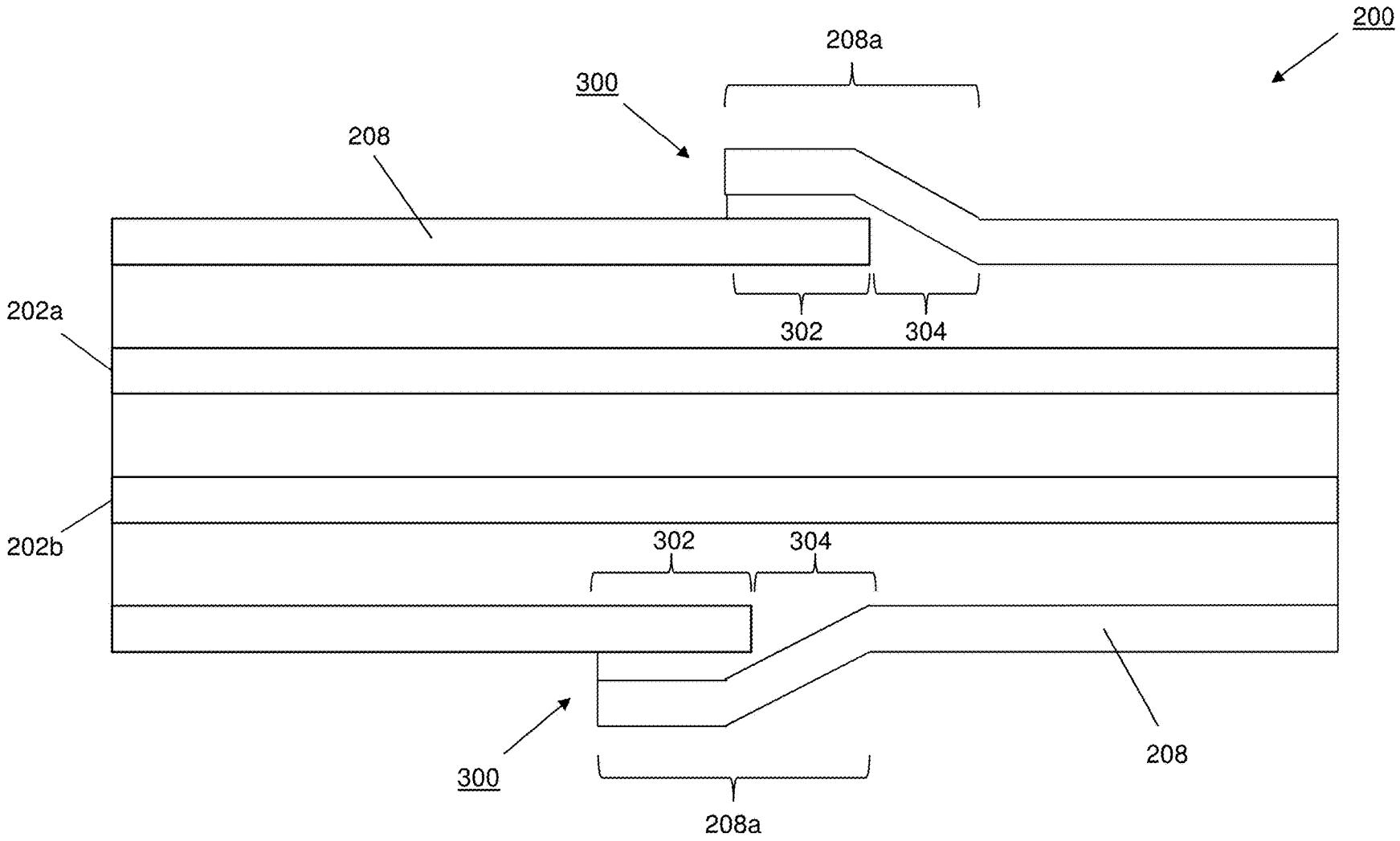
FIG. 3 is a schematic, cross-sectional view illustrating an embodiment of a cable with a spiral-wrapped cable shield.

With reference to FIG. 3, an embodiment of the cable 200 is illustrated to show features of the overlapping cable shield portions 208*a* on the cable shield 208 of the cable 200 discussed above with reference to FIG. 2, and thus similar element numbers are provided for similar features. Furthermore, one of skill in the art in possession of the present disclosure will recognize that some of the cable components of the cable 200 have been omitted in FIG. 3 for clarity. As can be seen in the embodiment illustrated in FIG. 3, any section of the overlapping shield portions 208*a* may operate (e.g., when a signal transmitted via the conductor(s) 202*a* and 202*b* to provide a return current via the cable shield 208) to create an LC circuit 300 (which may also be referred to as a resonant circuit, a tank circuit, or a tuned circuit) that includes a capacitive element 302 created by the separation of adjacent conducting sections in the overlapping cable shield portions 208*a* on the cable shield 208, and an inductive element 304 created by conducting sections in the overlapping cable shield portions 208*a* on the cable shield 208 that extend from the capacitive element 302. As will be appreciated by one of skill in the art in possession of the present disclosure, LC circuits may operate as electrical resonators that store energy that oscillates at the resonance frequency of the LC circuit.

Figure 4A:
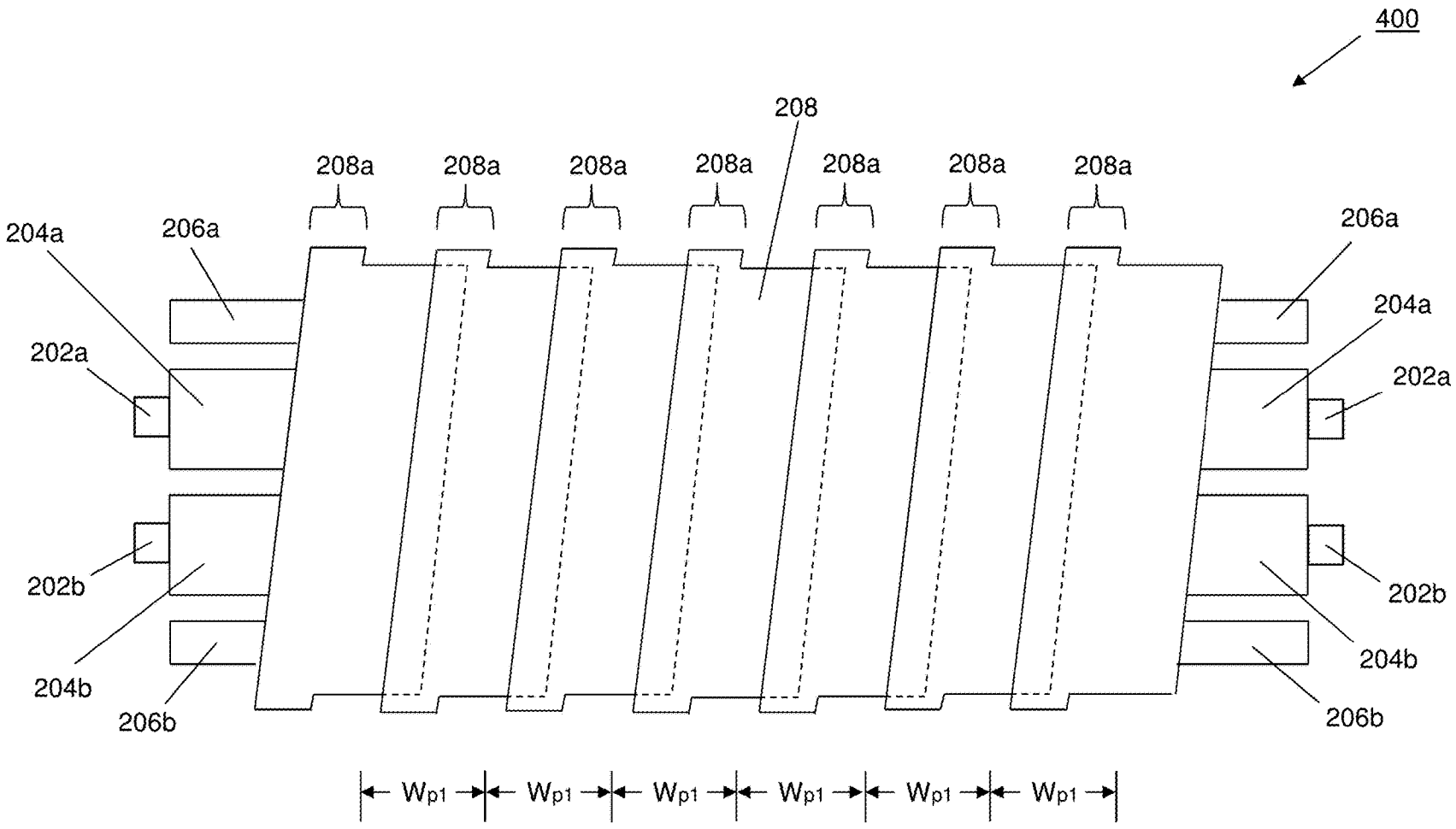
FIG. 4A (PRIOR ART)
FIG. 4A is a schematic view illustrating an embodiment of a cable with a conventional periodic spiral-wrapped cable shield.
Figure 4B:
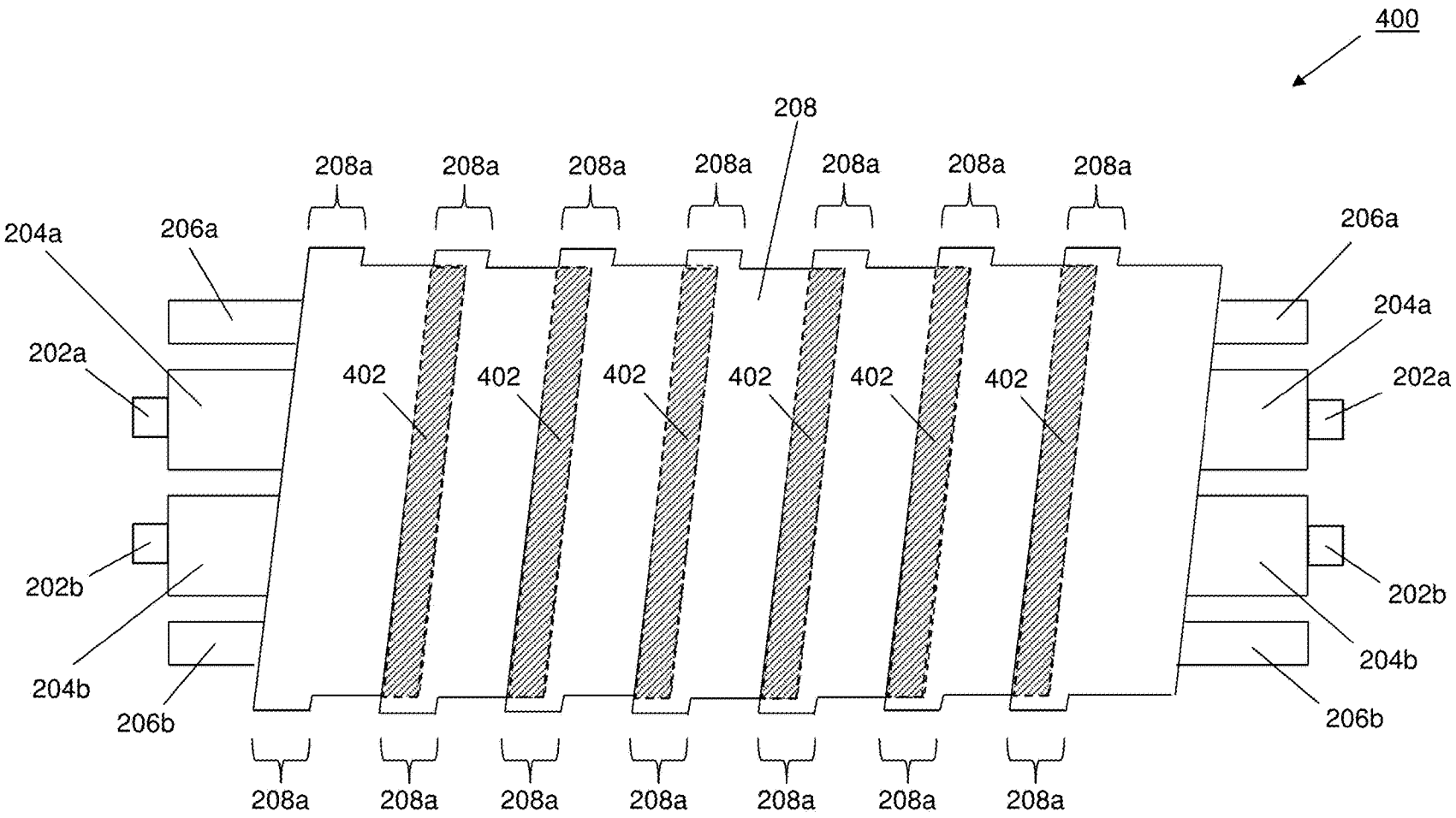
FIG. 4B (PRIOR ART)
FIG. 4B is a schematic view illustrating an embodiment of the cable with the conventional periodic spiral-wrapped cable shield of FIG. 4A.

Referring now to FIGS. 4A and 4B, an embodiment of a cable 400 including a conventional periodically overlapping spirally-wrapped cable shield is illustrated for purposes of discussing the benefits of the aperiodically overlapping spirally-wrapped cable shield of the present disclosure. As discussed above, the cable 200 discussed above with reference to FIGS. 2A, 2B, and 3 may be provided with a conventional periodically overlapping spirally-wrapped cable shield in order to provide the cable 400 illustrated in FIGS. 4A and 4B, and thus similar element numbers are provided for similar features. As will be appreciated by one of skill in the art in possession of the present disclosure, conventional spiral-wrapping cable shield systems may operate to manufacture the cable 400 illustrated in FIGS. 4A and 4B by feeding the cable components in the cable 400 through a cable shield spiral wrapping system at a constant cable feed rate, and spirally wrapping a constant width cable shield material (an example of which is illustrated and described in further detail below with reference to FIG. 10) around those cable components to provide the cable shield 208 with the overlapping cable shield portions 208*a* illustrated in FIGS. 4A and 4B.

As illustrated in FIGS. 4A and 4B, the conventional wrapping of the cable shield material in the manner described above provides the cable shield 208 with a constant wrap pitch $W_{p1}$ that produces the repeating overlapping cable shield portions 208*a* having repeating overlap areas 402 that are equal (or substantially equal) to each other along the length (or substantially along the length) of the cable 400. As such, the repeating overlapping cable shield portions 208*a* on the cable 400 create a plurality of the LC circuits discussed above that repeat along the length of the cable 400 and that each include equal (or substantially equal) capacitance and inductance. The "equality" or "substantially equality" of the overlap areas 402 and the LC circuits they create may be defined in terms of the resonance behavior of those LC circuits, and is discussed in further detail below with regard to the method 1200 of FIG. 12.

Figure 5:
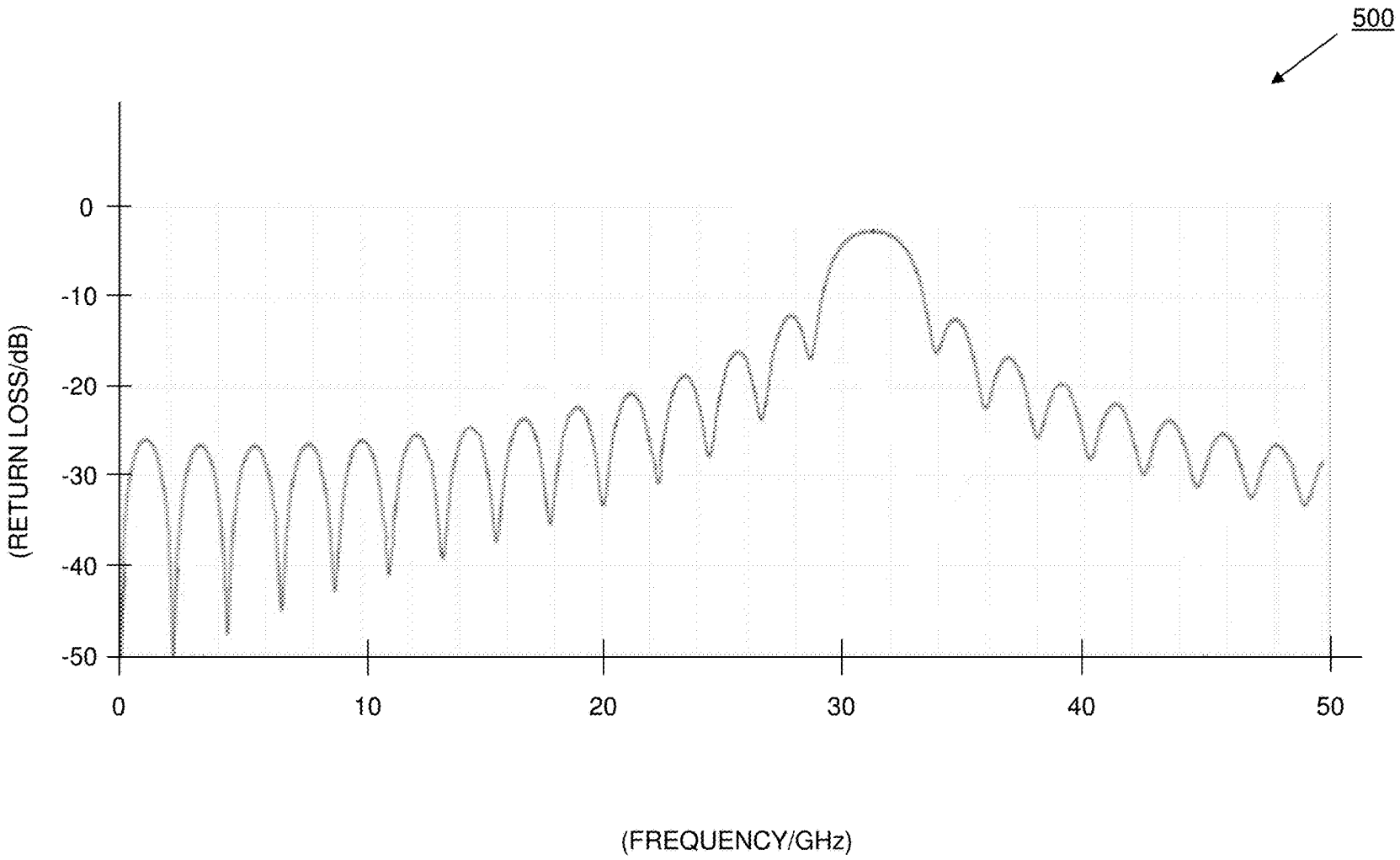
FIG. 5 (PRIOR ART)
FIG. 5 is a graph view illustrating an embodiment of return losses produced during the operation of the cable with the conventional periodic spiral-wrapped cable shield of FIGS. 4A and 4B.

With reference to FIG. 5, an embodiment of a return loss graph 500 is illustrated that may be produced by the cable 400 discussed above with reference to FIGS. 4A and 4B when a signal is transmitted using the cable components in that cable 400 such that a corresponding current returns via the cable shield 208 provided on that cable 400. As will be appreciated by one of skill in the art in possession of the present disclosure, each of the repeating LC circuits created by the overlapping cable shield portions 208*a* on the cable 400 will operate to produce return losses (e.g., due to signal reflection and/or other signal return loss events that would be apparent to one of skill in the art in possession of the present disclosure) in the signals transmitted using the cable 400 as a corresponding current returns via the cable shield 208 on that cable 400 and through those LC circuits, and the return loss graph 500 illustrates how those repeating LC circuits produce localized increases in those return losses at different signal transmission frequencies. Furthermore, the return loss graph 500 illustrates how the equal (or substantially equal) capacitance and inductance in those repeating LC circuits produces a periodic and repeating return path discontinuity in the cable shield 208 on the cable 400 that produces a resonance in return losses (e.g., due to signal reflection and/or other signal return losses that would be apparent to one of skill in the art in possession of the present disclosure) that increases to a maximum in a particular frequency range (e.g., between 30-33 Ghz in the illustrated embodiment).

Figure 6:
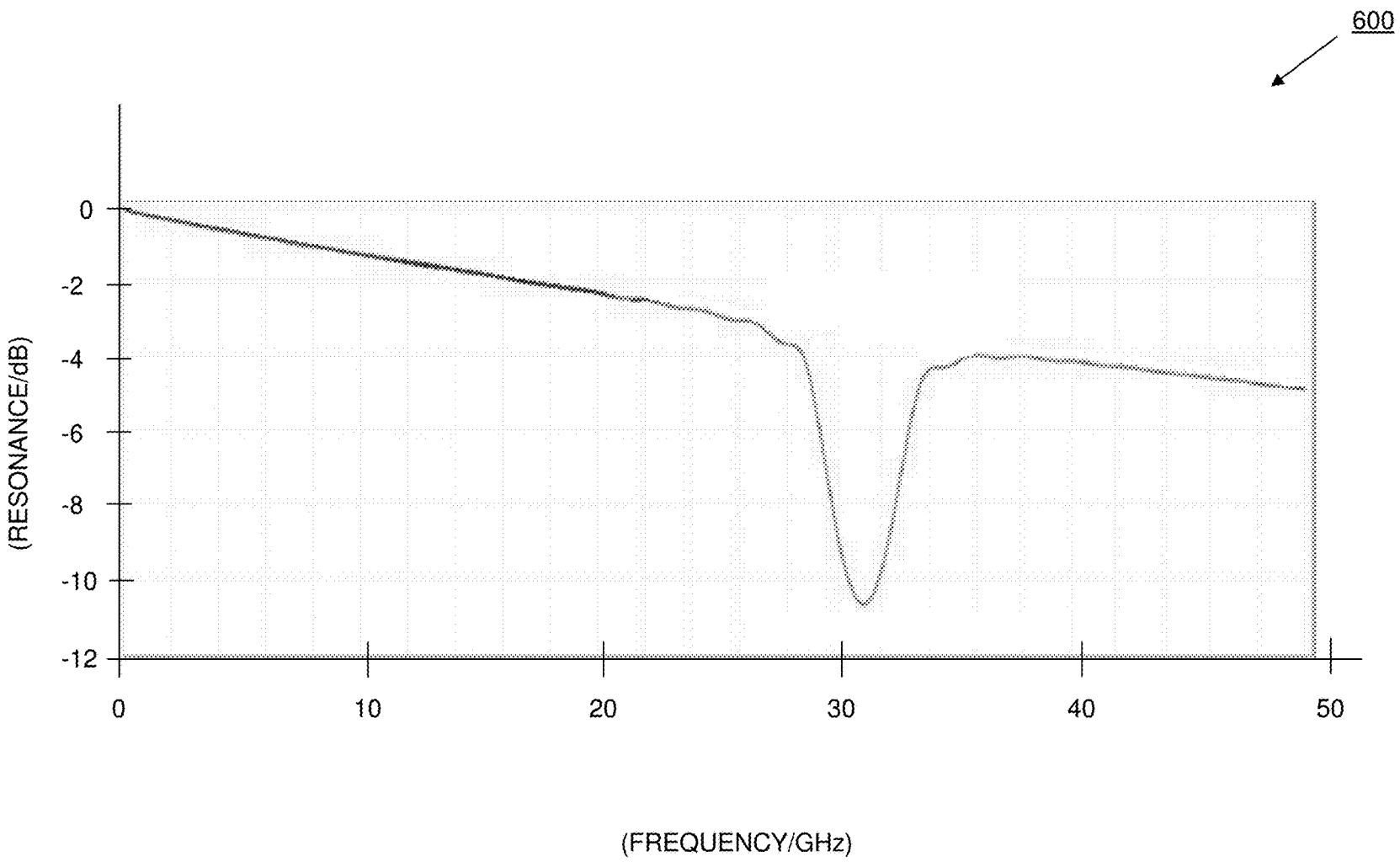
FIG. 6 (PRIOR ART)
FIG. 6 is a graph view illustrating an embodiment of resonance produced during the operation of the cable with the conventional periodic spiral-wrapped cable shield of FIGS. 4A and 4B.

With reference to FIG. 6, an embodiment of a resonance graph 600 is illustrated that may be produced by the cable 400 discussed above with reference to FIGS. 4A and 4B when a signal is transmitted using the cable components in that cable 400 and a corresponding current returns via the cable shield 208 provided on that cable 400. As will be appreciated by one of skill in the art in possession of the present disclosure, the return loss resonance produced by the repeating LC circuits that provide the periodic and repeating return path discontinuity in the cable shield 208 on the cable 400 creates a resonance/"suck-out" effect in a particular frequency range (e.g., between 30-33 Ghz in the illustrated embodiment) that results in the return losses discussed above and can attenuate signals that transmitted with that frequency range using the cable 400, resulting in signal losses. Furthermore, one of skill in the art in possession of the present disclosure will appreciate that the particular frequency range at which that resonance/"suck-out" effect is produced corresponds to signal transmission frequencies utilized to transmit relatively high speed signals. Thus, cables like the cable 400 that utilize conventional periodically overlapping spirally-wrapped cable shields may produce signal losses when relatively high-speed signals are transmitted using those cables.

Figure 7A:
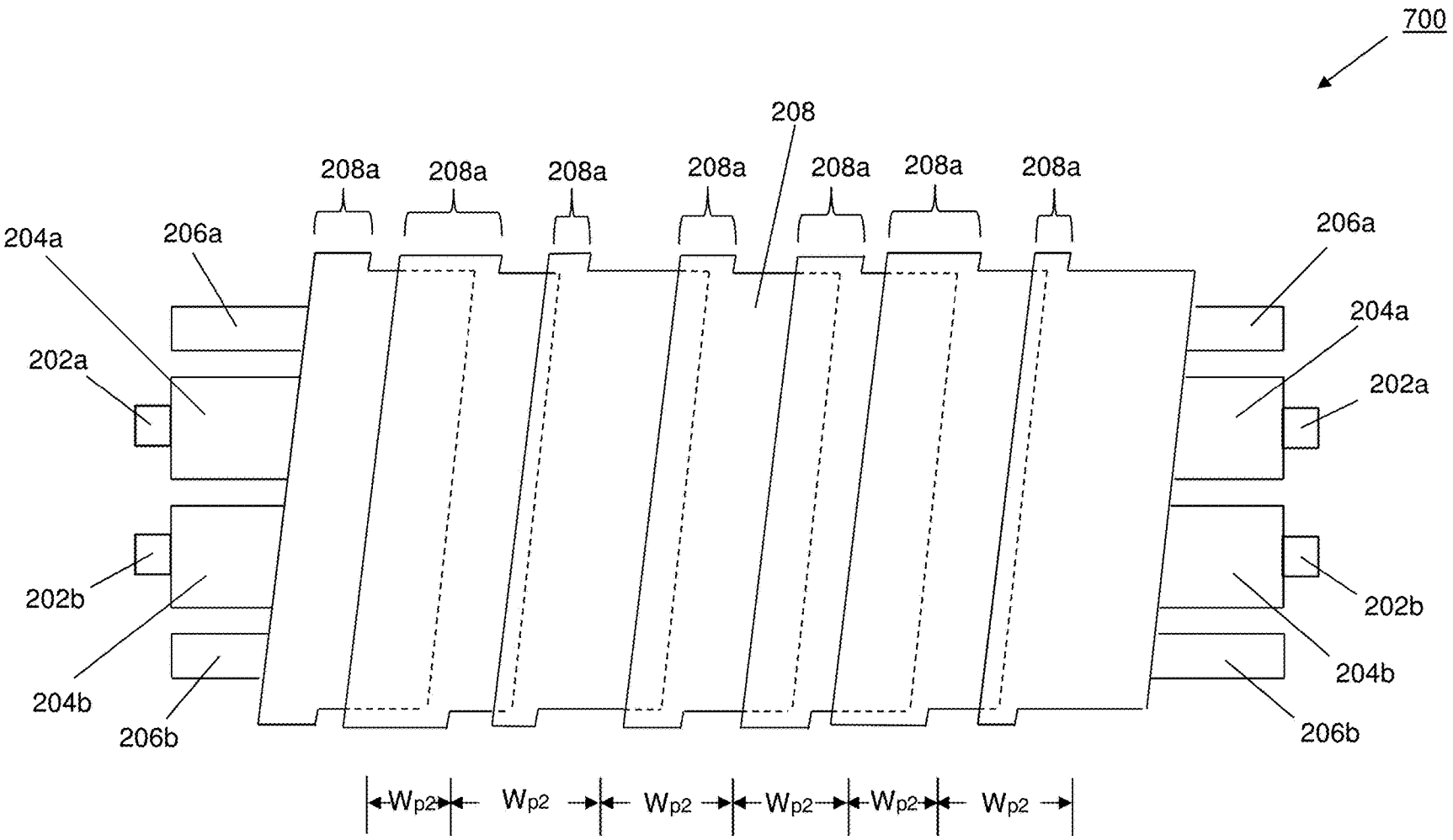
FIG. 7A is a schematic view illustrating an embodiment of a cable with the aperiodic spiral-wrapped cable shield of the present disclosure.
Figure 7B:
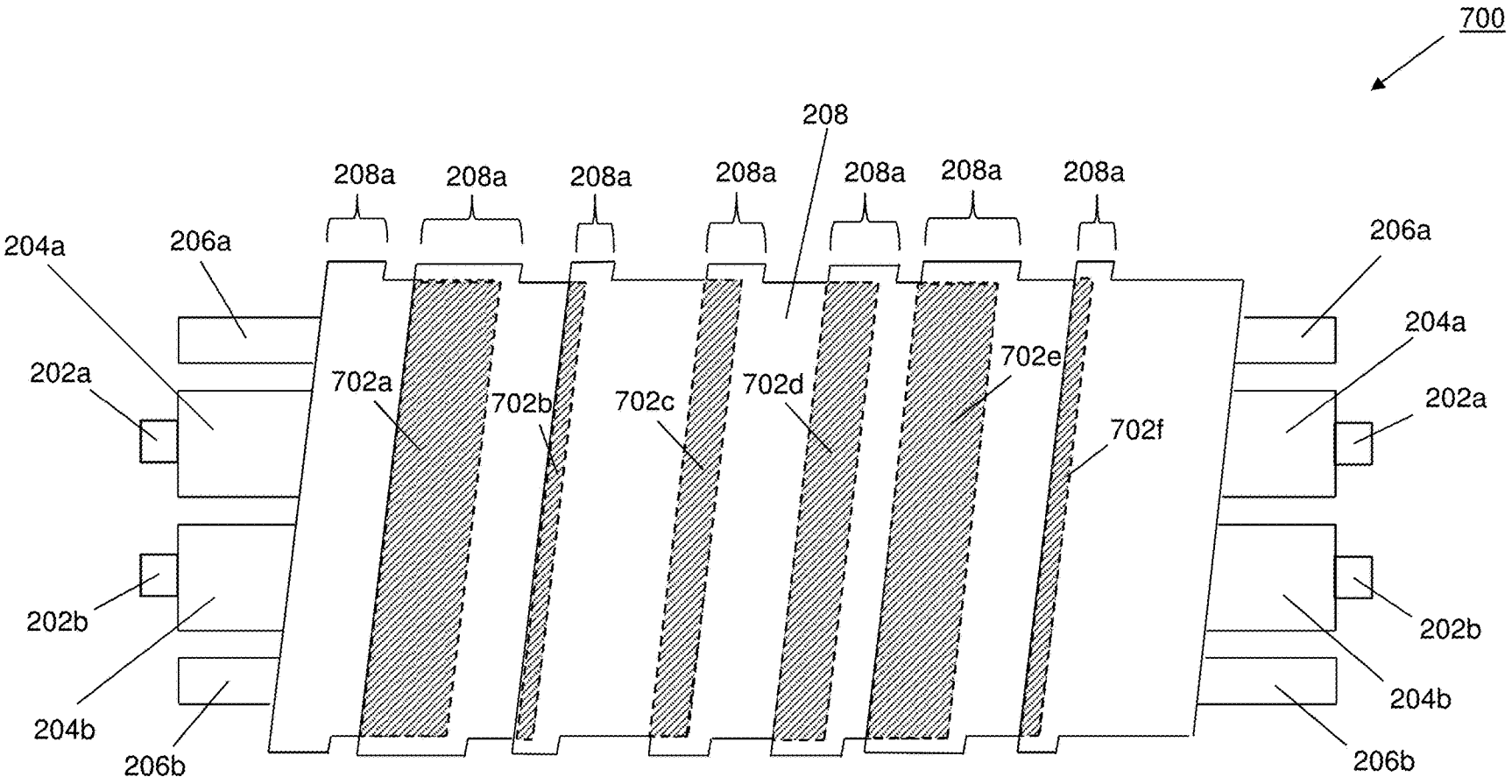
FIG. 7B is a schematic view illustrating an embodiment of the cable with the aperiodic spiral-wrapped cable shield of FIG. 7A.

Referring now to FIGS. 7A and 7B, an embodiment of a cable 700 including the aperiodically overlapping spirally-wrapped cable shield of the present disclosure is illustrated. As discussed above, the cable 200 discussed above with reference to FIGS. 2A, 2B, and 3 may be provided with an aperiodically overlapping spirally-wrapped cable shield in order to provide the cable 700 of FIGS. 7A and 7B, and thus similar element numbers are provided for similar features. In some embodiments, a conventional spiral-wrapping cable shield system may be utilized to manufacture the cable 700 illustrated in FIGS. 7A and 7B by feeding the cable components in the cable 400 through a cable shield spiral wrapping system at a varying cable feed rate, and spirally wrapping a constant width cable shield material (an example of which is illustrated and described in further detail below with reference to FIG. 10) around those cable components to provide the cable shield 208 with the overlapping cable shield portions 208*a* illustrated in FIGS. 7A and 7B and discussed in further detail below. In other embodiments, a conventional spiral-wrapping cable shield system may be utilized to manufacture the cable 700 illustrated in FIGS. 7A and 7B by feeding the cable components in the cable 400 through a cable shield spiral wrapping system at a constant cable feed rate, and spirally wrapping a varying width cable shield material (an example of which is illustrated and described in further detail below with reference to FIG. 11) around those cable components to provide the cable shield 208 with the overlapping cable shield portions 208*a* illustrated in FIGS. 7A and 7B and discussed in further detail below. However, while two specific techniques for providing the aperiodically overlapping spirally-wrapped cable shield of the present disclosure are illustrated and described herein, one of skill in the art in possession of the present disclosure will appreciate that other techniques may be utilized to provide the overlapping cable shield portions 208*a* on the cable shield 208 illustrated in FIGS. 7A and 7B and discussed in further detail below while remaining within the scope of the present disclosure as well.

As illustrated in FIGS. 7A and 7B, the wrapping of the cable shield material in the manner described above provides the cable shield 208 with a varying wrap pitch $W_{p2}$ that produces varying overlapping cable shield portions 208*a* having varying (or substantially varying) overlap areas 702*a*, 702*b*, 702*c*, 702*d*, 702*e*, and 702*f* that may be different from each other along the length (or substantially along the length) of the cable 700. As such, the varying overlapping cable shield portions 208*a* on the cable 700 create a plurality of the LC circuits discussed above that may be randomly positioned relative to each other along the length (or substantially along the length) of the cable 700, and that include a varying (or substantially varying) capacitance and inductance. The "varying" or "substantially varying" overlap areas 702*a*-702*f* and the LC circuits they create may be defined in terms of the resonance behavior of those LC circuits, and is discussed in further detail below with regard to the method 1200 of FIG. 12. However, one of skill in the art in possession of the present disclosure will recognize that the techniques discussed above for providing the aperiodic spiral-wrapped cable shield may, in some embodiments, produce a subset of the overlapping cable shield portions 208*a* with equal (or substantially equal) overlap areas that create equal (or substantially equal) LC circuits, but the number and/or relative positioning of those equal (or substantially equal) LC circuits will not be sufficient to produce resonance that exceeds a signal integrity resonance threshold for signals transmitted using the cable 700, discussed in further detail below with regard to the method 1200 of FIG. 12.

Figure 8:
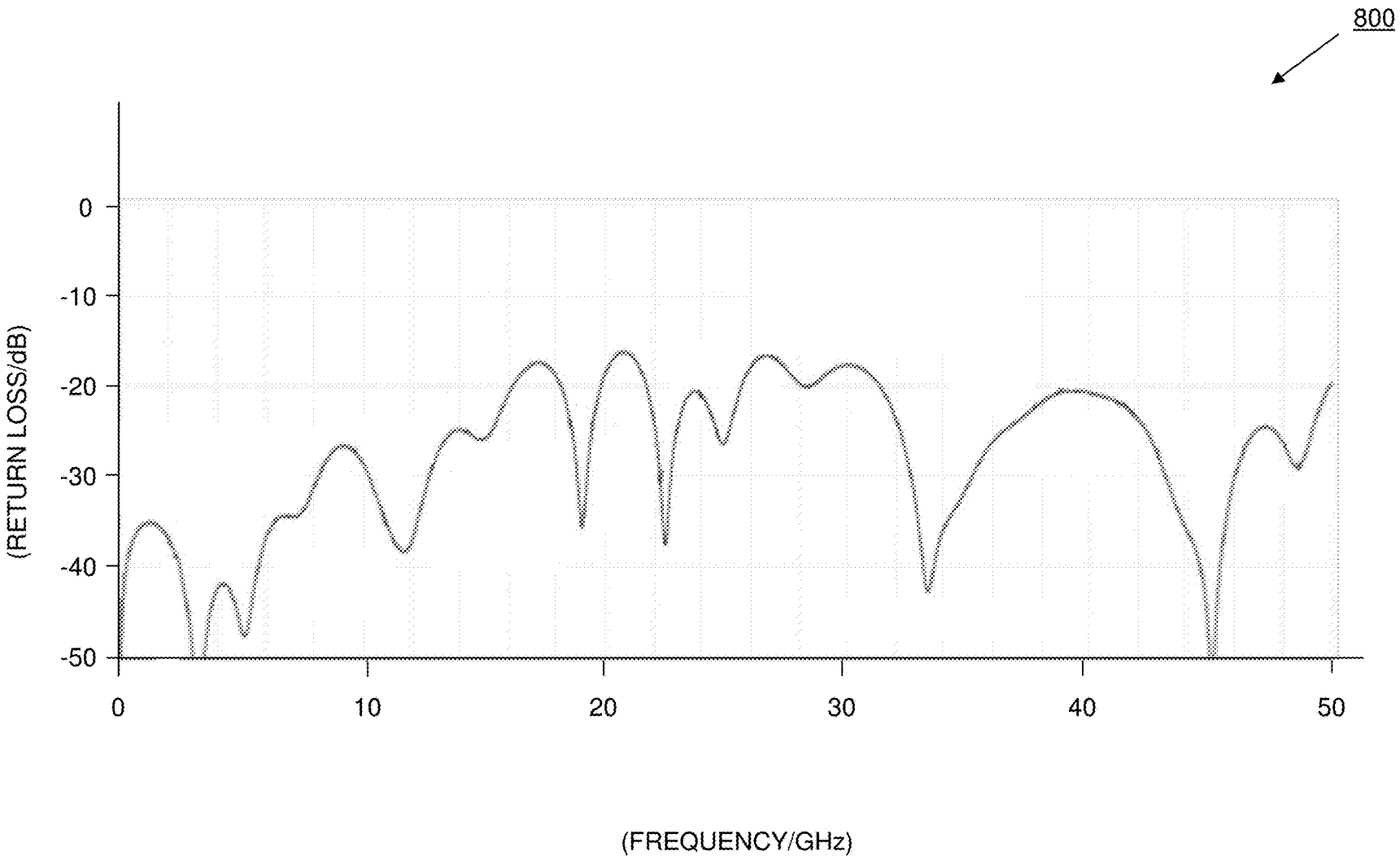
FIG. 8 is a graph view illustrating an embodiment of return losses produced during the operation of the cable with the aperiodic spiral-wrapped cable shield of FIGS. 7A and 7B.

With reference to FIG. 8, an embodiment of a return loss graph 800 is illustrated that may be produced by the cable 700 discussed above with reference to FIGS. 7A and 7B when a signal is transmitted using the cable components in that cable 4700 and a corresponding current returns via the cable shield 208 provided on that cable 700. As will be appreciated by one of skill in the art in possession of the present disclosure, each of the varying (or substantially varying) LC circuits created by the overlapping cable shield portions 208*a* on the cable 700 will operate to produce return losses (e.g., due to signal reflection and/or other signal return losses that would be apparent to one of skill in the art in possession of the present disclosure) in the signals transmitted using the cable 700 as a corresponding current return via the cable shield 208 on that cable 700 and through those LC circuits, and the return loss graph 800 illustrates how those varying (or substantially varying) LC circuits produce those return losses at different signal transmission frequencies. Furthermore, the return loss graph 800 illustrates how the varying (or substantially varying) capacitance and inductance in those varying (or substantially varying) LC circuits produces aperiodic and varying return path discontinuities in the cable shield 208 on the cable 700 that prevent the relatively high resonance in return losses in a particular frequency range (e.g., due to signal reflection and/or other signal return losses that would be apparent to one of skill in the art in possession of the present disclosure) that is produced by the cable 400 discussed above.

Figure 9:
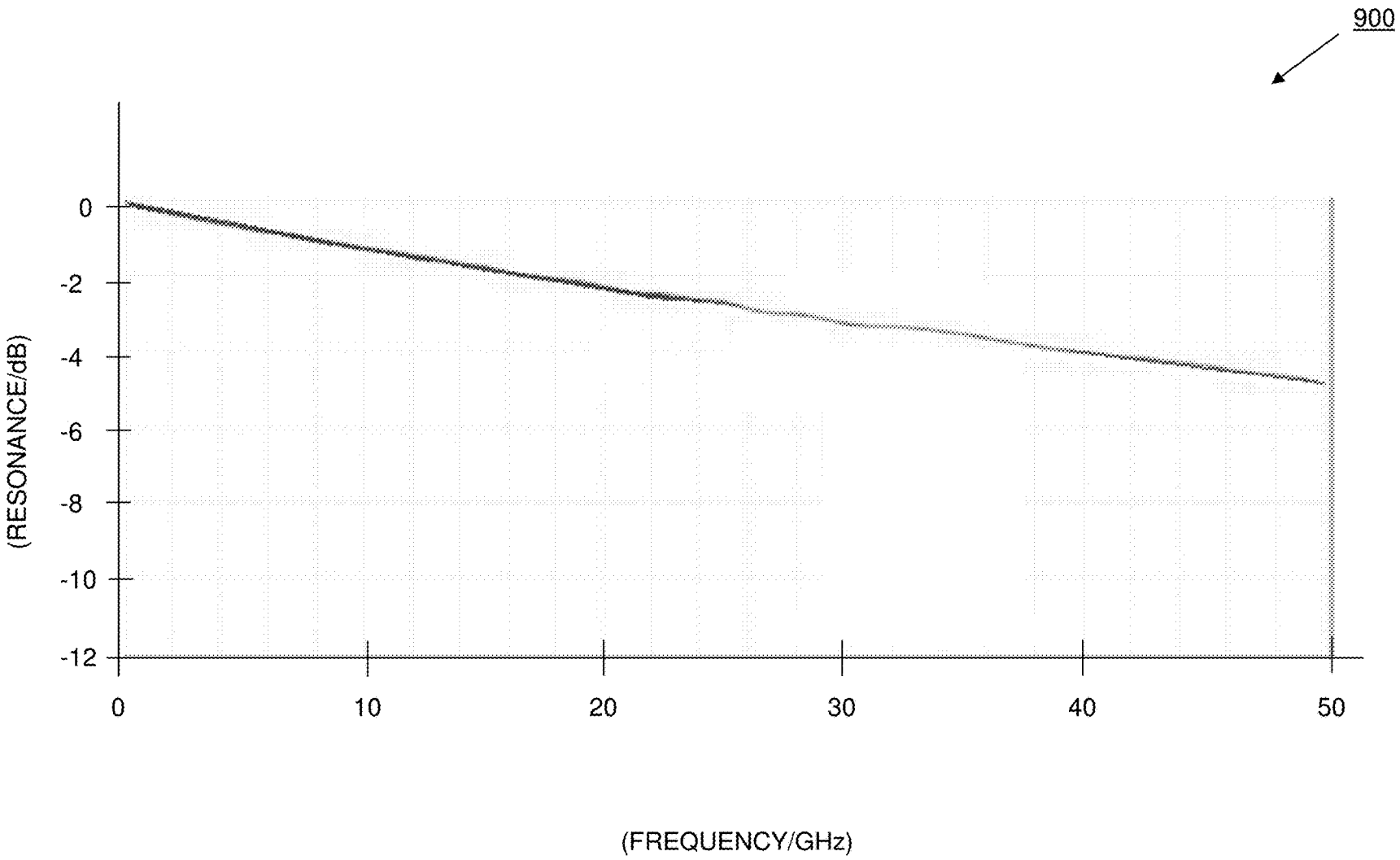
FIG. 9 is a graph view illustrating an embodiment of resonance produced during the operation of the cable with the aperiodic spiral-wrapped cable shield of FIGS. 7A and 7B.

With reference to FIG. 9, an embodiment of a resonance graph 900 is illustrated that may be produced by the cable 700 discussed above with reference to FIGS. 7A and 7B when a signal is transmitted using the cable components in that cable 700 and a corresponding current returns via the cable shield 208 provided on that cable 700. As will be appreciated by one of skill in the art in possession of the present disclosure, the return loss provided by the varying (or substantially varying) LC circuits that produce the aperiodic and varying return path discontinuities in the cable shield 208 on the cable 700 reduces or eliminates the resonance "suck-out" effect that is produced in the cable 400 in a particular frequency range, and that would otherwise result in the return losses discussed above that would attenuate the signal that is transmitted using the cable 700 within that frequency range, thus reducing or eliminating associated signal losses. As such, one of skill in the art in possession of the present disclosure will appreciate that relatively high speed signals may be transmitted using the cable 700 without producing the resonance/"suck-out" effect produced by the cable 400 in a particular frequency range when transmitting similar signals. Thus, cables like the cable 700 that utilize the aperiodically overlapping spirally-wrapped cable shield of the present disclosure will not experience signal losses when relatively high-speed signals are transmitted using those cables.

As will be appreciated by one of skill in the art in possession of the present disclosure, the cable shield spiral wrapping of the present disclosure that produces the aperiodically overlapping portions of the cable shield along the length of the cable prevents, reduces, or eliminates the repetitive and equal overlapping portions of conventional spiral-wrapped cable shields, thus reducing or eliminating the resonance intensity provided by the LC circuits created by such spiral-wrapped overlapping portions of the cable shield, and/or changing the resonance frequency of the LC circuits created by such spiral-wrapped overlapping portions of the cable shield. For example, the resonance frequency of LC circuits provided by spiral-wrapped overlapping portions of a cable shield may be determined using the equation below:

$$f=n/2t_{delay}$$

n=1, 2, . . .

$t_{delay}$=p/v (where p is the pitch frequency overlapping portions of the cable shield, and v is the signal transmission speed)

As such, depending on the pitch of the overlapping portions of the cable shield and the number of repetitions of the overlapping portions of the cable shield, the resonance frequency of the LC circuits may be determined.

One of skill in the art in possession of the present disclosure will appreciate that, by providing a random/varying pitch periodicity (e.g., wrapping the cable shield in a manner that prevents the pitch of the overlapping portions of the cable shield from repeating with equal overlap areas along a length of the cable), the aperiodically overlapping spirally-wrapped cable shield of the present disclosure may eliminate any lower degree periodic patterns of overlapping portions on the cable shield, thus eliminating lower degree periodic patterns of equal (or substantially equal) LC circuits. Thus, a plurality of varying, discrete, and/or different LC circuits will be created by the overlapping portions of the cable shield 208 on the cable 700, and the aperiodicity of those LC circuits prevents the resonance effects that would otherwise result in the "suck-out" effect discussed above. As will be appreciated by one of skill in the art in possession of the present disclosure, each LC circuit created by the overlapping portions of the cable shield will have a relatively high resonance that is outside of the range of signal transmission frequencies used to transmit signals via the cable, thus reducing the resonance intensity. For example, each LC circuit created by the overlapping portions of the cable shield will have a resonance frequency provided according to the following equations:

$$f_1 = 1/2t_{delay1},\ t_{delay1} = p_1/v$$

$$f_2 = 1/2t_{delay2},\ t_{delay2} = p_2/v$$

$$\ldots$$

$$f_n = 1/2t_{delayn},\ t_{delayn} = p_n/v$$

As will be appreciated by one of skill in the art in possession of the present disclosure, the discrete/varying repetitions of LC circuits created by the overlapping portions of the cable shield reduces the intensity of the resonance, and may be further dampened by losses in the channel. Furthermore, one of skill in the art in possession of the present disclosure will appreciate that, even when some subset of first LC circuits created by the overlapping portions of the cable shield are equal or substantially equal (e.g., due to randomness in the cable shield spiral-wrapping process), that subset of first LC circuits will be separate by, or bookended by, second LC circuits that are created by the overlapping portions of the cable shield and that produce different return losses that prevent or reduce the resonance behavior or "suck out" effect discussed above.

Figure 10:
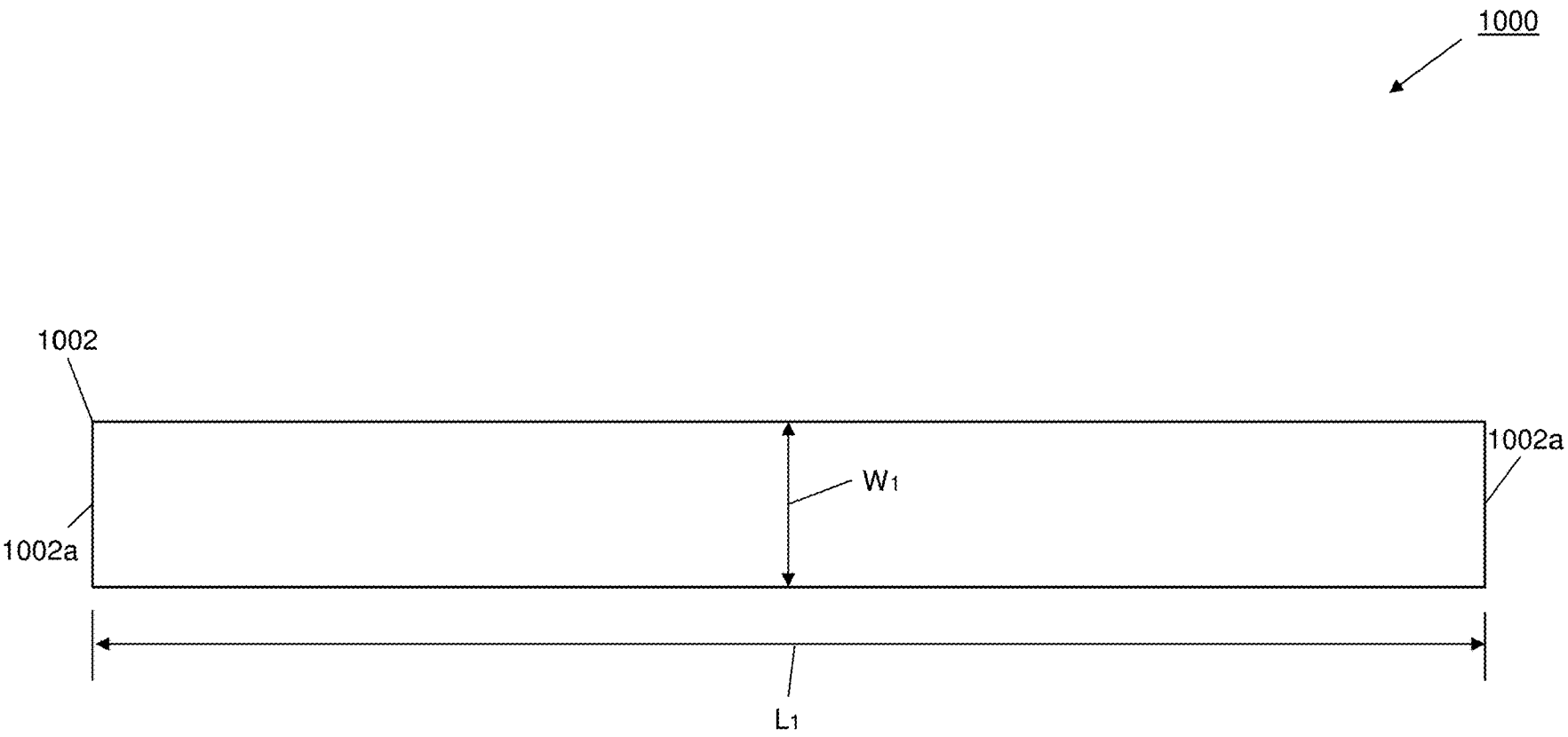
FIG. 10 is a schematic top view illustrating an embodiment of a cable shield material that may be used to provide the cable shield on the cable of FIGS. 7A and 7B.

Referring now to FIG. 10, an embodiment of cable shield material 1000 is illustrated that may be utilized to provide the cable shield 208 on the cable 700 discussed above. In the embodiment illustrated in FIG. 10, the cable shield material includes a base 1002 having a first end 1002*a* and a second end 1002*b* that is located opposite the base 1002 from the first end 1002*a*. As illustrated, the base 1002 includes a length $L_1$ and a constant width $W_1$ along that length $L_1$. As will be appreciated by one of skill in the art in possession of the present disclosure and as discussed above, the cable shield material 1000 may be provided in a cable shield spiral-wrapping system, and cable components may be fed through the cable shield spiral-wrapping system at a varying feed rate while the cable shield material 1000 is spirally wrapped around those cable components (e.g., starting with the first end 1002*a* at a first end of the cable components to provide a first end of a spirally-wrapped cable shield on that cable, and ending with the second end 1002*b* at a second end of the cable components to provide a second end of the spirally-wrapped cable shield on that cable). Thus, the cable shield material 1000 illustrated in FIG. 10 provides an example of constant width cable shield material that may be utilized in a cable shield spiral-wrapping system while the cable components are fed through cable shield spiral-wrapping system at a varying feed rate in order to produce the aperiodically overlapping spirally-wrapped cable shield of the present disclosure.

Figure 11:
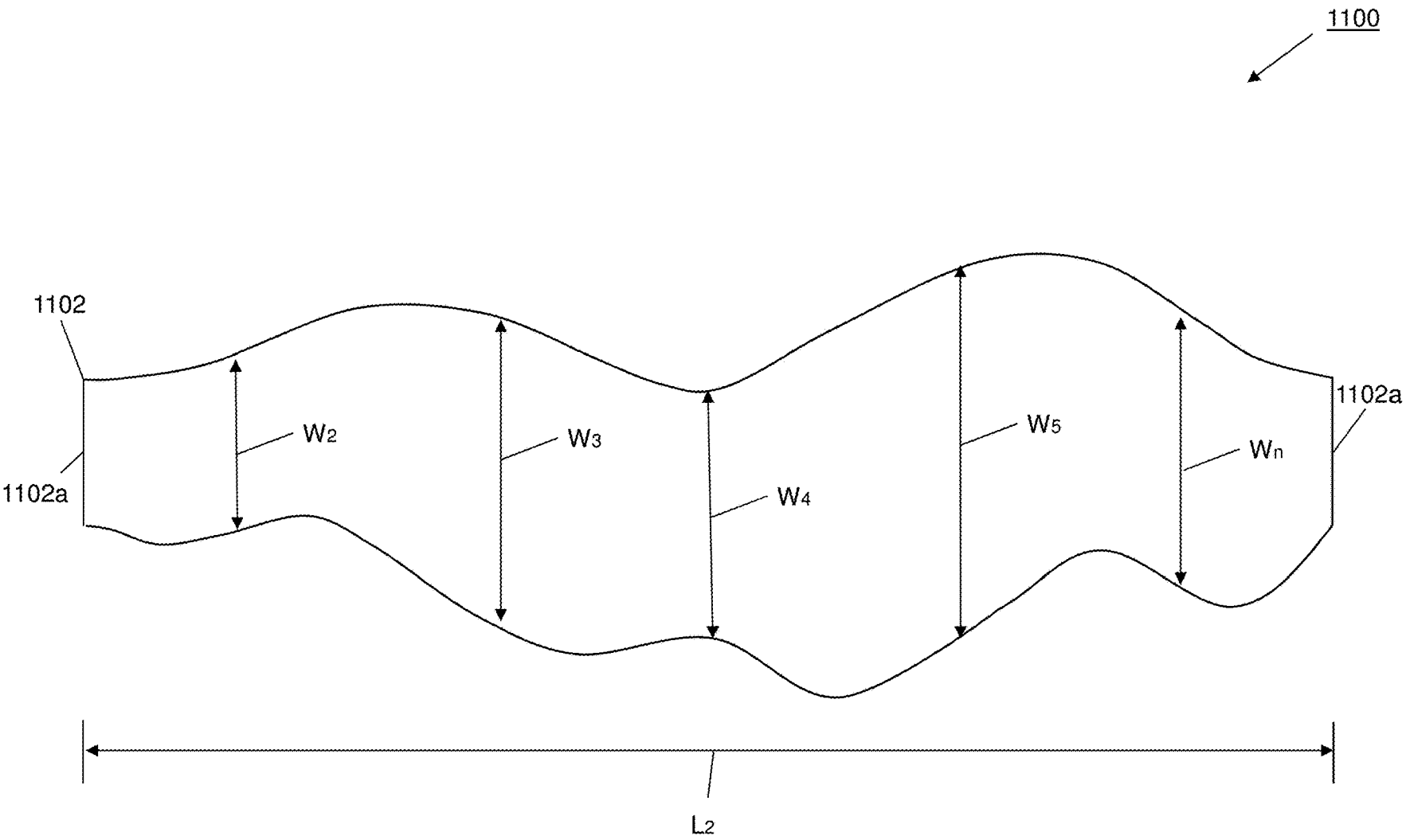
FIG. 11 is a schematic top view illustrating an embodiment of a cable shield material that may be used to provide the cable shield on the cable of FIGS. 7A and 7B.

Referring now to FIG. 11, an embodiment of cable shield material 1100 is illustrated that may be utilized to provide the cable shield 208 on the cable 700 discussed above. In the embodiment illustrated in FIG. 11, the cable shield material includes a base 1102 having a first end 1102*a* and a second end 1102*b* that is located opposite the base 1102 from the first end 1102*a*. As illustrated, the base 1102 includes a length $L_2$ and a varying width $W_2$, $W_3$, $W_4$, $W_5$, and up to $W_n$, along that length $L_2$. As will be appreciated by one of skill in the art in possession of the present disclosure and as discussed above, the cable shield material 1100 may be provided in a cable shield spiral-wrapping system, and cable components may be fed through the cable shield spiral-wrapping system at a constant feed rate while the cable shield material 1100 is spirally wrapped around those cable components (e.g., starting with the first end 1102*a* at a first end of the cable components to provide a first end of a spirally-wrapped cable shield on that cable, and ending with the second end 1102*b* at a second end of the cable components to provide a second end of the spirally-wrapped cable shield on that cable). Thus, the cable shield material 1100 illustrated in FIG. 11 provides an example of varying width cable shield material that may be utilized in a cable shield spiral-wrapping system while the cable components are fed through cable shield spiral-wrapping system at a constant feed rate in order to produce the aperiodically overlapping spirally-wrapped cable shield of the present disclosure.

Figure 12:
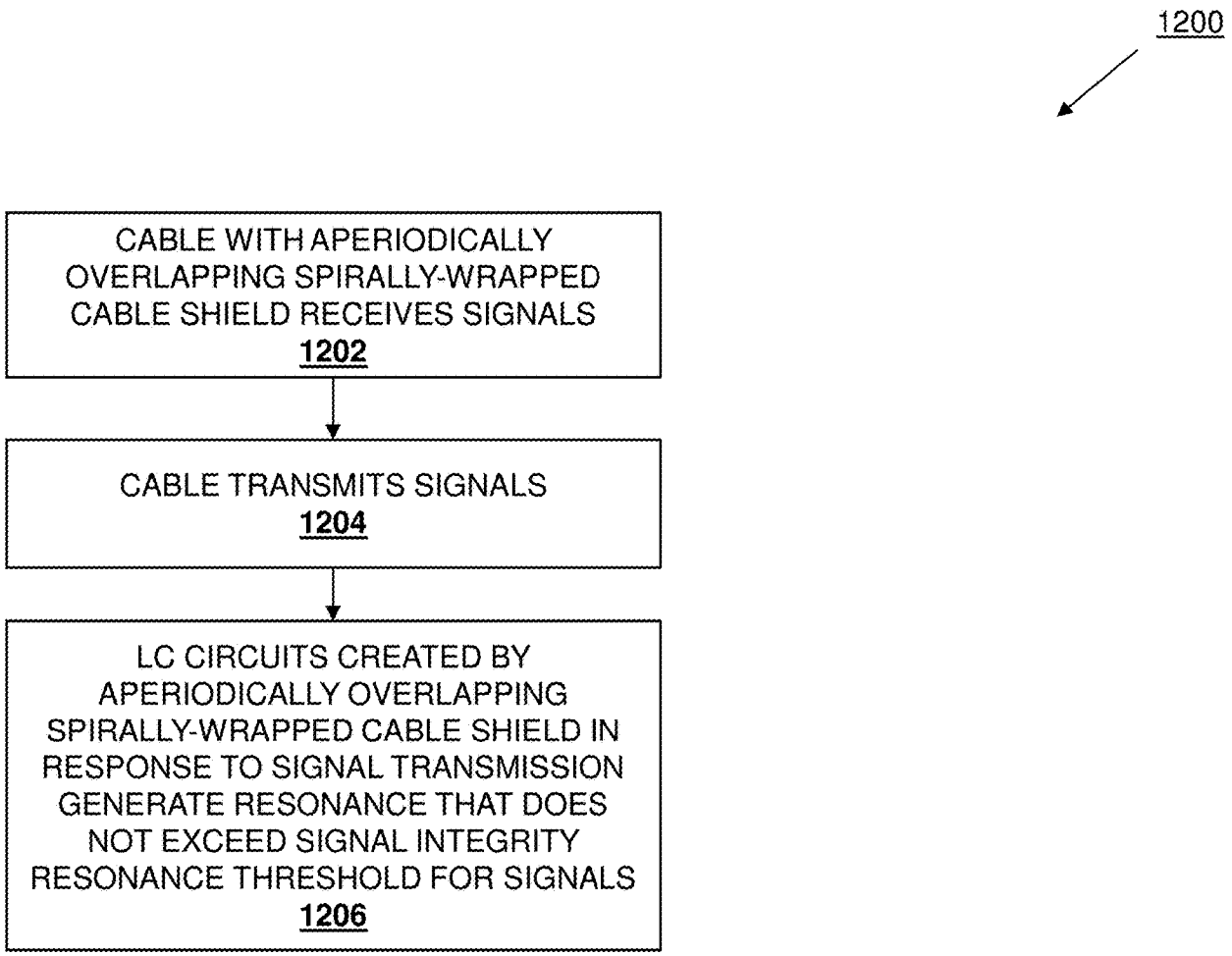
FIG. 12 is a flow chart illustrating an embodiment of a method for transmitting a signal using a cable having an aperiodically overlapping spiral-wrapped cable shield.

Referring now to FIG. 12, an embodiment of a method 1200 for transmitting a signal using a cable having an aperiodically overlapping spiral-wrapped cable shield is illustrated. As discussed below, the systems and methods of the present disclosure provide cables with spirally-wrapped cable shields that include aperiodically overlapping cable shield portions with varying overlap areas that, in response to the transmission of signals via those cables, generate a resonance that does not exceed a signal integrity resonance threshold for the signals. For example, the aperiodically overlapping spiral-wrapped cable shield system of the present disclosure may include a cable having cable components such as a pair of conductors, at least one insulator surrounding the pair of conductors, and at least one drain wire. The cable also includes a cable shield that is spirally wrapped around the cable components with a varying wrap pitch that provides a plurality of overlapping cable shield portions with varying overlap areas. When signals are transmitted using the cable components in the cable, the varying overlap areas of the plurality of overlapping cable shield portions create a plurality of varying LC circuits that are configured to generate a resonance that does not exceed a signal integrity resonance threshold for signals. As such, cables with the spirally-wrapped cable shield of the present disclosure may be utilized to transmit relatively high-speed signals without the associated possibilities of signal attenuation/energy reduction that accompanies cables with conventional spirally-wrapped cable shields.

The method 1200 begins at block 1202 where a cable with an aperiodically overlapping spirally-wrapped cable shield receives signals. In an embodiment, at block 1202, the cable 700 may be connected to a computing device provided by, for example, the IHS 100 discussed above with reference to FIG. 1. In an embodiment, that computing device may include a processing system, and a memory system that is coupled to the processing system and that includes instructions that, when executed by the processing system, cause the processing system to provide a signal transmission engine that is configured to generate signals. As such, at block 1202, the computing device may generate signals and provide those signals to a connector on the computing device to which the cable 700 is connected such that one or more of the cable components in the cable 700 (e.g., the conductors 202*a* and 202*b*) receive those signals. In an embodiment, the signals may be received by the cable 700 at block 1202 at a signal transmission speed of 3 GHz and above (one of skill in the art in possession of the present disclosure will appreciate that the "suck out" effect discussed above depends on cable materials and geometry, but typically occurs at several GHz, and the systems and methods of the present disclosure will prevent any "suck out" effect occurring due to resonance when the "suck out"

frequency would otherwise be provided in the frequency range where the signal has significant energy).

The method 1200 then proceeds to block 1204 where the cable transmits the signals. In an embodiment, at block 1204 and in response to receiving the signals from the computing device at block 1202, the cable components in the cable 700 (e.g., the conductors 202*a* and 202*b*) may operate to transmit those signals along the length of the cable 700. As discussed above, the transmission of signals via the cable 700 will result in a corresponding current returning via the cable shield 208.

The method 1200 then proceeds to block 1206 where LC circuits created by the aperiodically overlapping spirally-wrapped cable shield in response to the signal transmission generate a resonance that does not exceed a signal integrity resonance threshold for the signals. In an embodiment, at block 1206, the return current in the cable shield 208 on the cable 700 (in response to the transmission of signals via the cable components in the cable 700) will flow through LC circuits created by the varying overlap areas provided in the plurality of overlapping cable shield portions on the cable shield 208, which will cause those LC circuits to generate a resonance that does not exceed a signal integrity resonance threshold for the signals being transmitted via the cable 700.

As will be appreciated by one of skill in the art in possession of the present disclosure, the conventional spiral wrapping of cable shields discussed above produces overlapping cable shield portions that have equal or substantially equal overlap areas that produce equal or substantially equal LC circuits, and the "equal"/"substantially equal" terminology is utilized herein to describe the relationship between the overlap areas and the LC circuits they create that operate to generate resonance that produces the "suck-out" effect described above at a frequency at which signals will be transmitted using the cable 400. As such, overlap areas of overlapping cable shield portions on a cable shield and the LC circuits they create may be "equal" or "substantially equal" when they produce a resonance at frequencies at which signals will be transmitted using the cable 208, and that resonance exceeds a signal integrity resonance threshold in a frequency range that causes the return losses discussed above at a level that produces undesirable signal attenuation/energy reduction in the signals transmitted via the cable 400 in that frequency range.

Thus, one of skill in the art in possession of the present disclosure will appreciate that the aperiodic spiral wrapping of cable shields discussed above produces overlapping cable shield portions that have varying or substantially varying overlap areas that produce varying or substantially varying LC circuits, and the "varying"/"substantially varying" terminology is utilized herein to describe the relationship between the overlap areas and the LC circuits they create that operate to generate resonance that will not produce the "suck-out" effect described above at a frequency at which signals will be transmitted using the cable 700. As such, overlap areas of overlapping cable shield portions on a cable shield and the LC circuits they create may be "varying" or "substantially varying" when they produce resonance that does not exceed a signal integrity resonance threshold and that does not cause the return losses discussed above at a level that produces undesirable signal attenuation/energy reduction in the signals transmitted via the cable 700 in that frequency range.

Thus, systems and methods have been described that provide cables with spirally-wrapped cable shields that include aperiodically overlapping cable shield portions with varying overlap areas that, in response to the transmission of signals via those cables, generate a resonance that does not exceed a signal integrity resonance threshold for the signals. As such, cables with the spirally-wrapped cable shield of the present disclosure may be utilized to transmit relatively high-speed signals without the associated possibilities of signal attenuation that accompanies cables with conventional spirally-wrapped cable shields. One of skill in the art in possession of the present disclosure will appreciate that the systems and methods of the present disclosure provide a low-cost method (e.g., using conventional spiral-wrapping cable shield systems) to provide spiral-wrapped cable shields for cables that do not exhibit the negative effects on high speed signals that are provided by conventional spiral-wrapped cable shields, as opposed to solutions that provide uniform-thickness cable shields that increase in cost exponentially as the length of their corresponding cables increase, or that replace electrical signal conducting cable components with optical signal transmission components that also increase costs.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An aperiodically overlapping spiral-wrapped cable shield system, comprising:

at least one cable component; and a cable shield that is spirally wrapped around the at least one cable component with a varying wrap pitch that provides a plurality of overlapping cable shield portions with varying overlap areas, wherein the varying overlap areas of the plurality of overlapping cable shield portions create a plurality of varying LC circuits that are configured to generate a resonance that does not exceed a signal integrity resonance threshold for signals transmitted using the at least one cable component.

2. The system of claim 1, wherein the at least one cable component includes:

a pair of conductors; and at least one insulator surrounding the pair of conductors.

3. The system of claim 2, wherein the at least one cable component includes:

at least one drain wire.

4. The system of claim 1, wherein the cable shield includes a constant cable shield width.

5. The system of claim 1, wherein the cable shield includes a varying cable shield width.

6. The system of claim 1, wherein the resonance that does not exceed the signal integrity resonance threshold for the signal transmitted using the at least one cable component provides a resonance level that does not produce return losses in the signal that exceed a return loss threshold.

7. An Information Handling System (IHS), comprising:

a processing system;

a memory system that is coupled to the processing system and that includes instructions that, when executed by the processing system, cause the processing system to provide a signal transmission engine that is configured to generate signals; and a cable that is coupled to the processing system and that is configured to transmit the signals, wherein the cable includes:

a cable shield that is spirally wrapped with a varying wrap pitch that provides a plurality of overlapping cable shield portions with varying overlap areas, wherein the varying overlap areas of the plurality of overlapping cable shield portions create a plurality of varying LC circuits that are configured to generate a resonance that does not exceed a signal integrity resonance threshold for the signals.

8. The IHS of claim 7, wherein the cable includes:

a pair of conductors; and at least one insulator surrounding the pair of conductors, wherein the at least one insulator is spirally wrapped within the cable shield.

9. The IHS of claim 7, wherein the cable includes:

at least one drain wire that is spirally wrapped within the cable shield.

10. The IHS of claim 7, wherein the cable shield includes a constant cable shield width.

11. The IHS of claim 7, wherein the cable shield includes a varying cable shield width.

12. The IHS of claim 7, wherein the resonance that does not exceed the signal integrity resonance threshold for the signals provides a resonance level that does not produce return losses in the signal that exceed a return loss threshold.

13. The IHS of claim 7, wherein the signals are transmitted at a signal transmission speed of at least 3 GHz.

14. A method for transmitting a signal using a cable having an aperiodically overlapping spiral-wrapped cable shield, comprising:

receiving signals at a cable that includes a cable shield that is spirally wrapped with a varying wrap pitch that provides a plurality of overlapping cable shield portions with varying overlap areas;

transmitting, via at least one cable component in the cable, the signals; and generating, by a plurality of varying LC circuits created by the varying overlap areas of the plurality of overlapping cable shield portions in response to the transmission of the signals via, a resonance that does not exceed a signal integrity resonance threshold for the signals.

15. The method of claim 14, wherein the cable includes:

a pair of conductors; and at least one insulator surrounding the pair of conductors, wherein the at least one insulator is spirally wrapped within the cable shield.

16. The method of claim 14, wherein the cable includes:

at least one drain wire that is spirally wrapped within the cable shield.

17. The method of claim 14, wherein the cable shield includes a constant cable shield width.

18. The method of claim 14, wherein the cable shield includes a varying cable shield width.

19. The method of claim 14, wherein the resonance that does not exceed the signal integrity resonance threshold for the signals provides a resonance level that does not produce return losses in the signal that exceed a return loss threshold.

20. The method of claim 14, wherein the signals are transmitted at a signal transmission speed of at least 3 Ghz.

* * * * *